US009469424B2

(12) United States Patent
Zhou

(10) Patent No.: US 9,469,424 B2
(45) Date of Patent: Oct. 18, 2016

(54) PACKAGING DEVICE

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventor: Hai-Bo Zhou, Shenzhen (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 492 days.

(21) Appl. No.: 14/033,821

(22) Filed: Sep. 23, 2013

(65) Prior Publication Data

US 2014/0096480 A1 Apr. 10, 2014

(30) Foreign Application Priority Data

Oct. 10, 2012 (CN) ..... 2012 1 0381087

(51) Int. Cl.
*B65B 5/04* (2006.01)
*B65B 13/18* (2006.01)

(52) U.S. Cl.
CPC ..... *B65B 5/04* (2013.01); *B65B 13/181* (2013.01)

(58) Field of Classification Search
CPC ..... B65B 5/04; B65B 13/181
USPC ..... 53/139.7, 472, 139.5
See application file for complete search history.

(56) References Cited

U.S. PATENT DOCUMENTS 3,378,987 A * 4/1968 Lems ..... B65B 13/181 100/3
3,585,780 A * 6/1971 Elmore ..... B65B 13/181 100/26
3,830,895 A * 8/1974 Theodorsen ..... B29C 33/00 264/321
5,226,280 A * 7/1993 Scherer ..... B65B 13/181 221/211
5,289,668 A * 3/1994 Meyer ..... B65B 13/181 53/139.7
5,423,118 A * 6/1995 Lotti ..... B65B 13/181 29/809

(Continued)

FOREIGN PATENT DOCUMENTS

DE 4038942 A1 * 6/1992 ..... B65B 13/181
DE 10012484 A1 * 9/2001 ..... B65B 13/181

(Continued)

*Primary Examiner* — Hemant M Desai
*Assistant Examiner* — Lucas Palmer
(74) *Attorney, Agent, or Firm* — Zhigang Ma

(57) ABSTRACT

A packaging device comprises a frame, a conveying mechanism mounted on the frame, and two loading mechanisms mounted on opposite sides of the frame. The conveying mechanism holds a workpiece. The loading mechanism includes a feeding assembly and a pushing assembly. The feeding assembly includes a first driver mounted on the frame, and a bearing member movably mounted on the guiding base and connected to the first driver, for holding a number of protection members. The pushing assembly includes a second driver fixed on a top surface of the frame, and a pushing member connected to the second driver.

19 Claims, 9 Drawing Sheets

(56) References Cited

U.S. PATENT DOCUMENTS

| | | | | | |
|---|---|---|---|---|---|
| 5,535,572 | A * | 7/1996 | Morantz | B65B 11/025 | 53/139.7 |
| 5,546,730 | A * | 8/1996 | Newell | B65B 11/585 | 53/139.7 |
| 5,564,254 | A * | 10/1996 | Thimon | B65B 11/025 | 53/139.6 |
| 5,596,863 | A * | 1/1997 | Kasel | B65B 13/181 | 414/789.5 |
| 6,178,721 | B1 * | 1/2001 | Turfan | B65B 11/025 | 53/139.7 |
| 6,418,700 | B1 * | 7/2002 | Parcels | B65B 23/00 | 53/139.7 |
| 6,964,149 | B2 * | 11/2005 | Iwamura | B65B 5/024 | 53/218 |
| 8,938,934 | B2 * | 1/2015 | Brunson | B65B 9/135 | 53/139.7 |
| 2002/0014052 | A1 * | 2/2002 | Suolahti | B65B 13/181 | 53/139.7 |
| 2003/0051439 | A1 * | 3/2003 | Lancaster, III | B65B 11/025 | 53/399 |
| 2005/0108989 | A1 * | 5/2005 | Dickner | B65B 13/181 | 53/445 |
| 2006/0168911 | A1 * | 8/2006 | Owen | B65B 11/08 | 53/397 |
| 2006/0266002 | A1 * | 11/2006 | Zitella | B65B 13/181 | 53/139.7 |
| 2012/0076631 | A1 * | 3/2012 | Wang | B65G 65/00 | 414/792.7 |

FOREIGN PATENT DOCUMENTS

| | | | | | |
|---|---|---|---|---|---|
| DE | EP 1908709 | A1 * | 4/2008 | B65G 47/90 | |
| DE | WO 2010029451 | A1 * | 3/2010 | B65B 13/181 | |
| DE | 202013002503 | U1 * | 6/2014 | B65B 13/06 | |
| FR | 1351883 | A * | 5/1964 | B65B 13/025 | |
| FR | EP 0538148 | A1 * | 4/1993 | B25J 9/041 | |
| IT | WO 2010061312 | A2 * | 6/2010 | B65B 23/20 | |
| IT | EP 2500283 | A1 * | 9/2012 | B65B 13/181 | |
| WO | WO 2014039887 | A1 * | 3/2014 | B65B 13/181 | |

* cited by examiner

PACKAGING DEVICE

BACKGROUND

1. Technical Field

The present disclosure relates to packaging devices, and particularly to a packaging device capable of packaging at least two protection members to edges of a workpiece.

2. Description of Related Art

Edges of a workpiece can be packaged with protection members, such as foam pieces, before being shipped to avoid damage during transporting of the workpiece. However, the protection members are packaged to the workpiece manually, which is inefficient because of high labor costs and the corresponding amount of time the procedure requires.

Therefore, there is room for improvement in the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
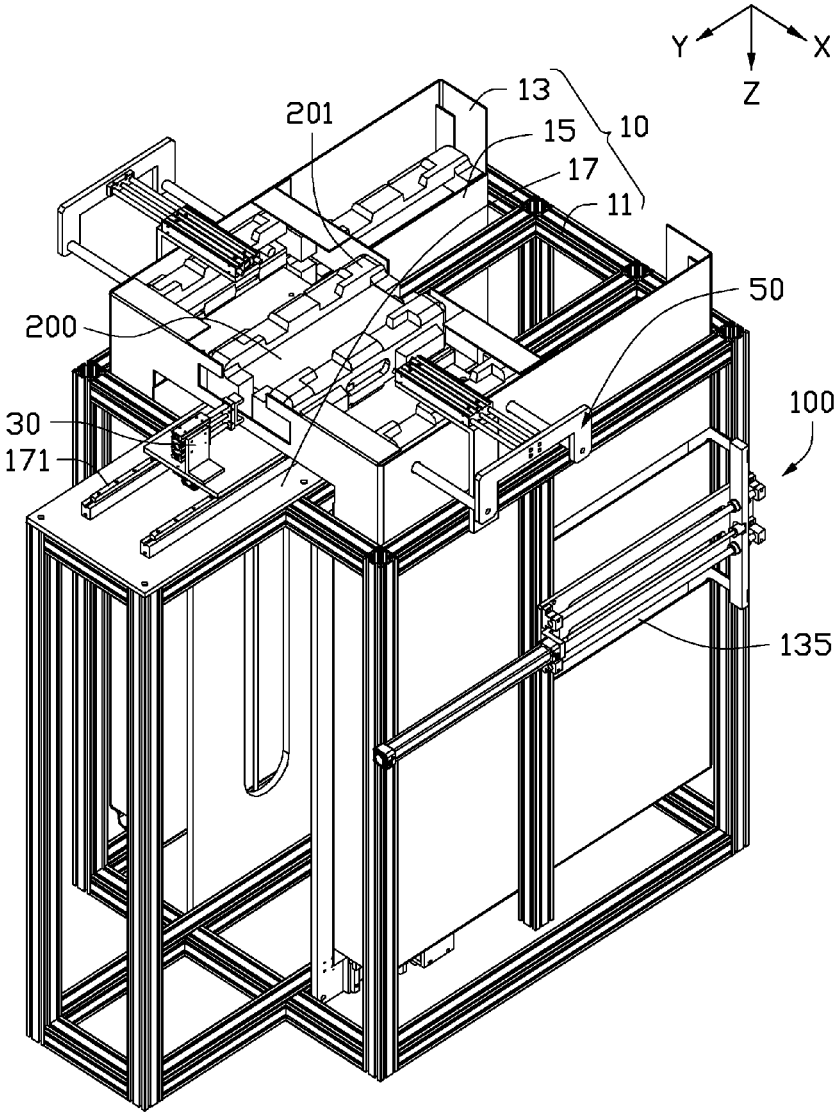
FIG. 1 is an isometric view of an embodiment of a packaging device comprising a feeding assembly and a pre-feeding assembly.

FIG. 1 shows one embodiment of a packaging device 100. The packaging device 100 is configured to package at least two protection members 201 to edges of a workpiece 200. In the illustrated embodiment, the workpiece 200 is substantially rectangular, and the at least two protection members 201 are packaged to opposite edges of the workpiece 200, respectively. The protection members 201 are made of foam, and the shape of the protection members 201 are in substantially bar-like blocks. The protection member 201 defines a slot corresponding to an edge of the workpiece 200.

The packaging device 100 includes a mounting base 10, a conveying mechanism 30 mounted on the mounting base 10, and two loading mechanisms 50 mounted on opposite sides of the mounting base 10, respectively. The conveying mechanism 30 is mounted on a top surface of the mounting base 10, to convey and hold the workpiece 200 at a packaging position. The two loading mechanisms 50 are positioned on opposite sides of the mounting base 10, respectively, and are partly located above the mounting base 10.

The loading mechanisms 50 are located at opposite sides of the workpiece 200, respectively. After the conveying mechanism 30 conveys and holds the workpiece 200 at the packaging position, each of the loading mechanisms 50 loads one protection member 201 and fittingly packs the protection member 201 to a corresponding edge of the workpiece 200.

Figure 2:
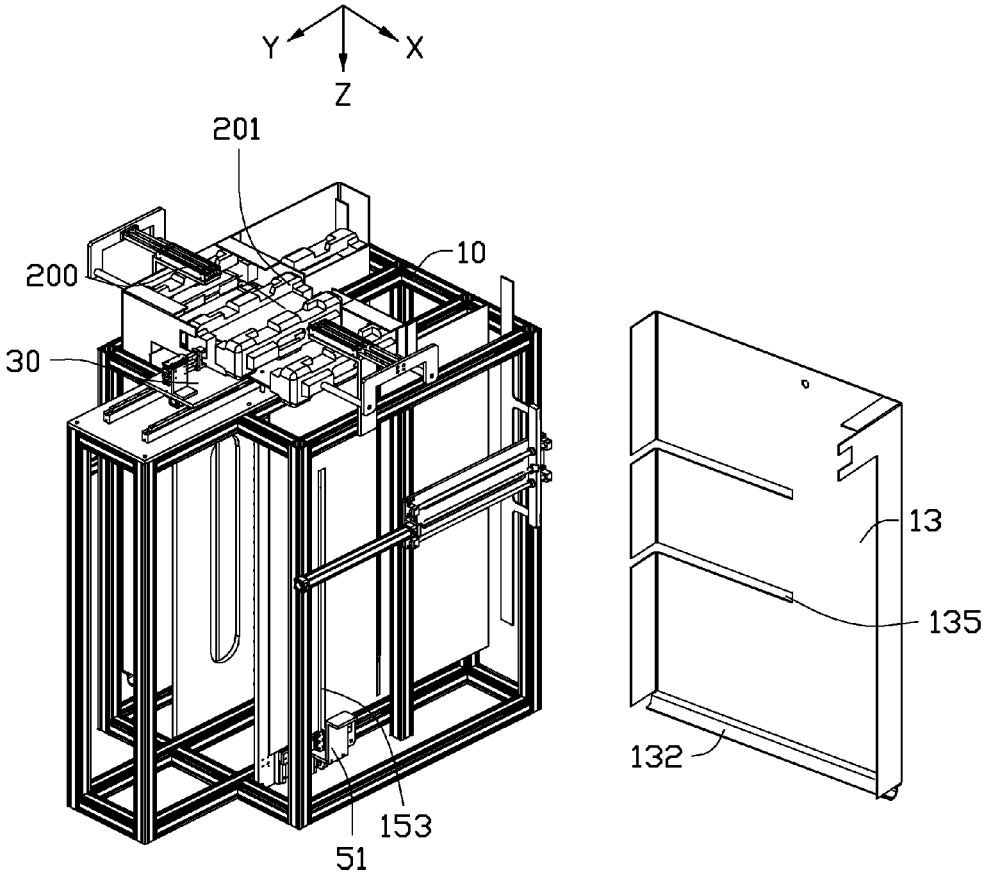
FIG. 2 is a partial exploded, isometric view of the packaging device shown in FIG. 1.
Figure 3:
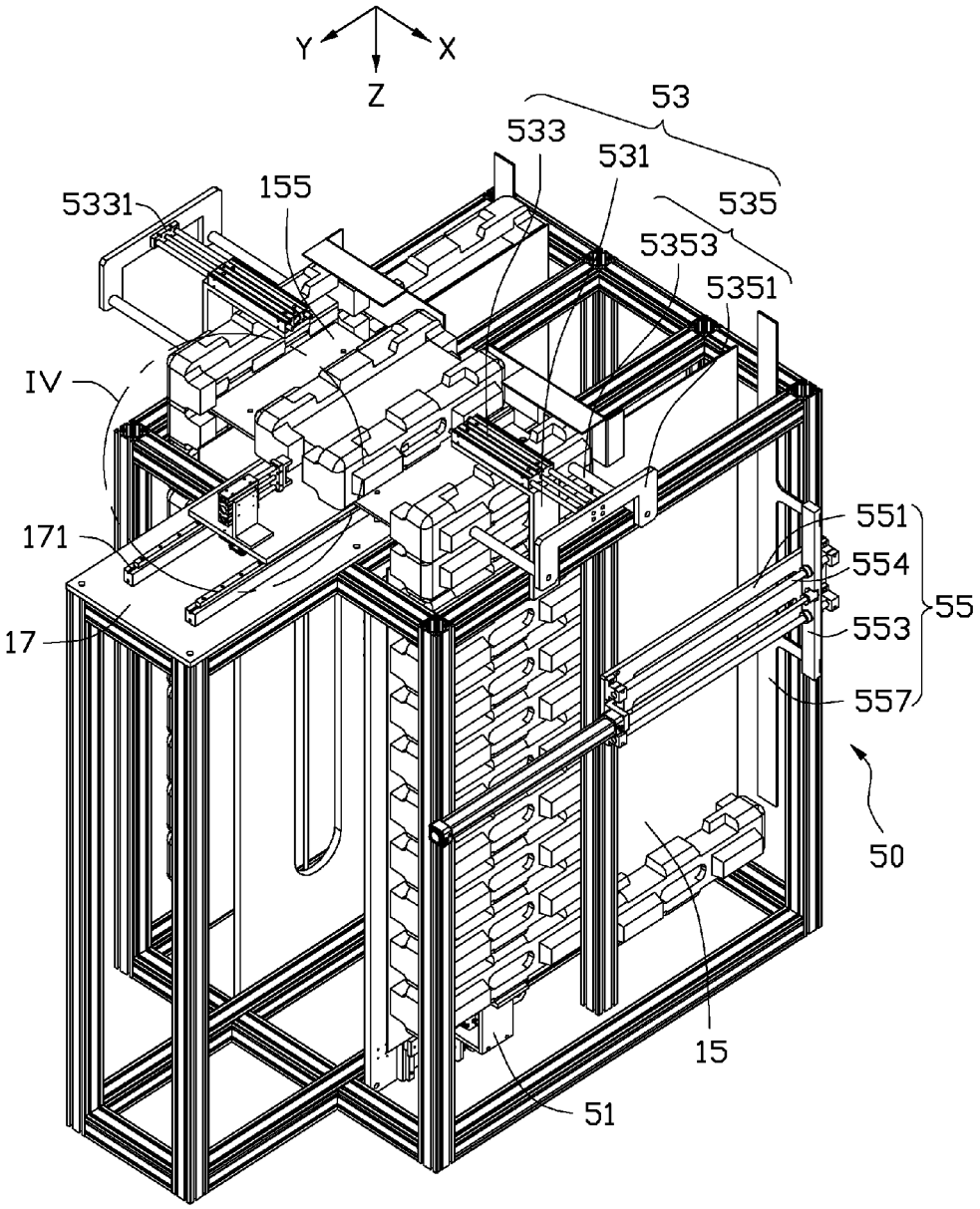
FIG. 3 is a partial assembled, isometric view of the packaging device shown in FIG. 1.

FIGS. 1 to 3 show the mounting base 10. The mounting base 10 includes a frame 11, two first mounting plates 13, two second mounting plates 15, and a third mounting plate 17. The first mounting plates 13 are respectively fixed on opposite sides of the frame 11. A support portion 132 extends from a bottom edge of each of the two first mounting plates 13, for supporting a plurality of protection members 201. The first mounting plate 13 defines a pair of guiding grooves 135 extending along a X direction in a Cartesian coordinate system. The pair of guiding grooves 135 is substantially parallel to the support portion 132. Each second mounting plate 15 is mounted to the frame 11 at a side of one corresponding first mounting plate 13. Each second mounting plate 15 and the corresponding first mounting plate 13 cooperatively define a receiving chamber (not labeled), for receiving the protection members 201. The support portion 132 supports the protection members 201. Each of the second mounting plates 15 defines a sliding groove 153 (shown in FIG. 2) along a Z direction in a Cartesian coordinate system, and each sliding groove 153 is positioned at a side of the second mounting plate 15 adjacent to the conveying mechanism 30. The Z direction is substantially perpendicular to the Y direction. Two guiding portions 155 (shown in FIG. 3) extend substantially perpendicularly from a top edge of the corresponding second mounting plate 15 towards each other. The packaging position is located above the guiding portions 155 of the second mounting plates 15. The third mounting plate 17 is positioned on a top surface of the frame 11, and is positioned below the guiding portion 155 along a direction perpendicular to the Z direction. A pair of guiding rails 171 extending along the Y direction is positioned on the third mounting plate 17. The guiding rails 171 are parallel to each other, for mounting the conveying mechanism 30.

Figure 4:
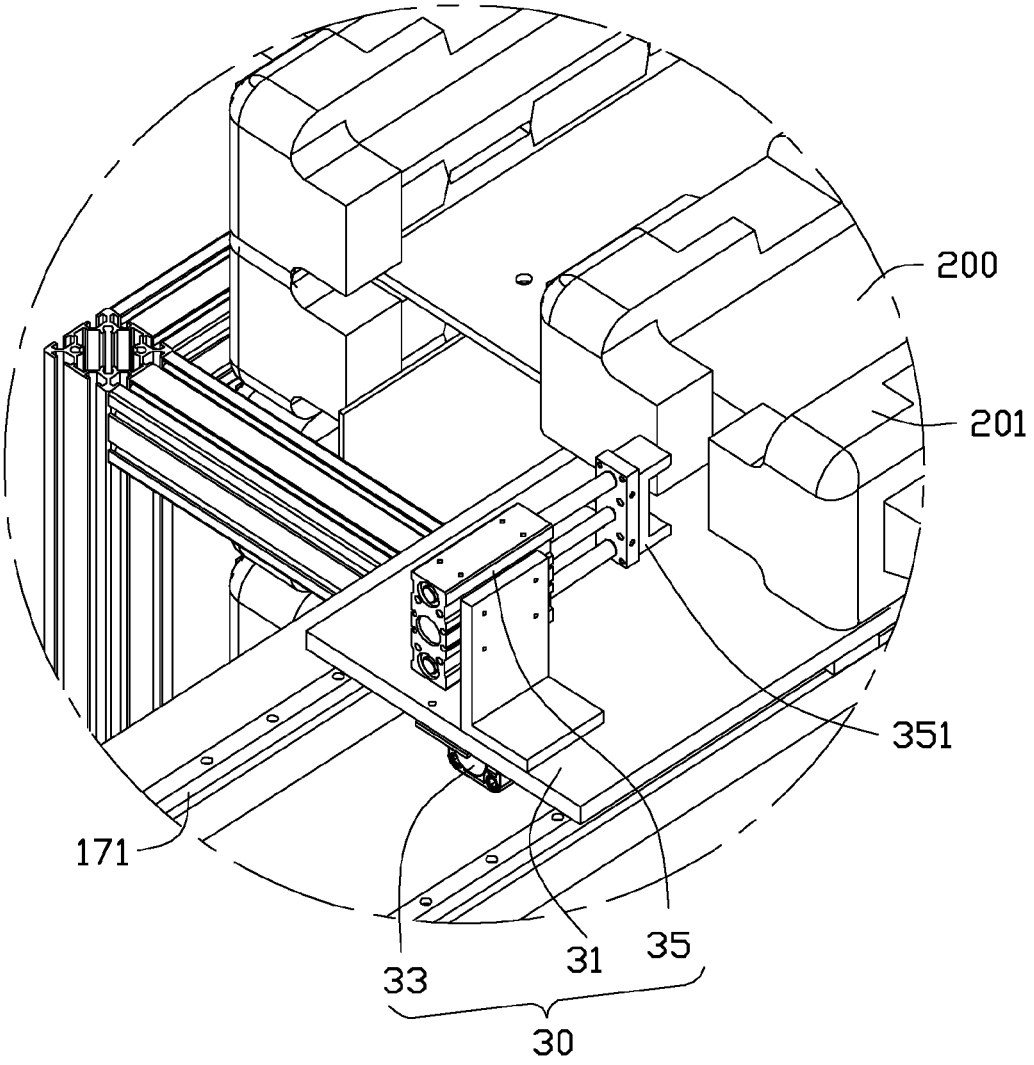
FIG. 4 is an enlarged view of a circled portion IV of the packaging device shown in FIG. 3.
Figure 5:
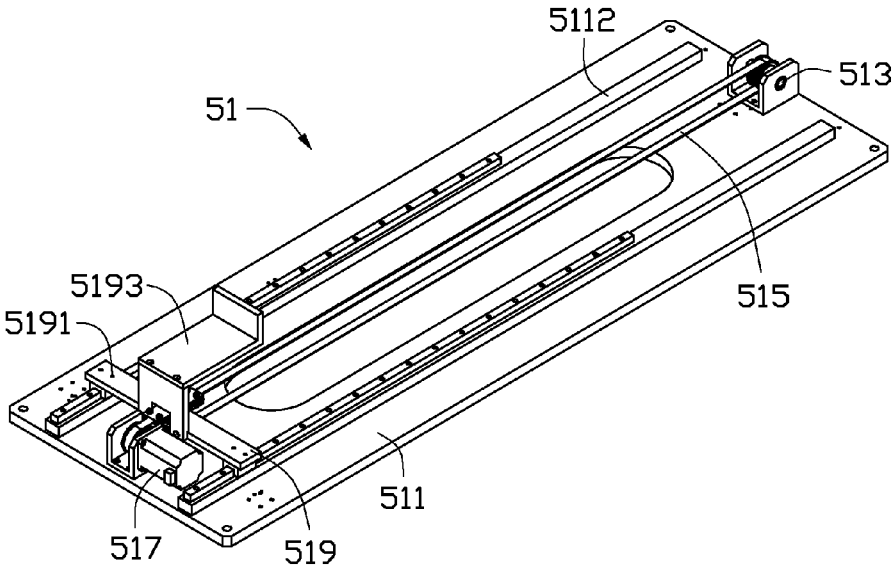
FIG. 5 is an enlarged, isometric view of the feeding assembly of the packaging device shown in FIG. 1.
Figure 6:
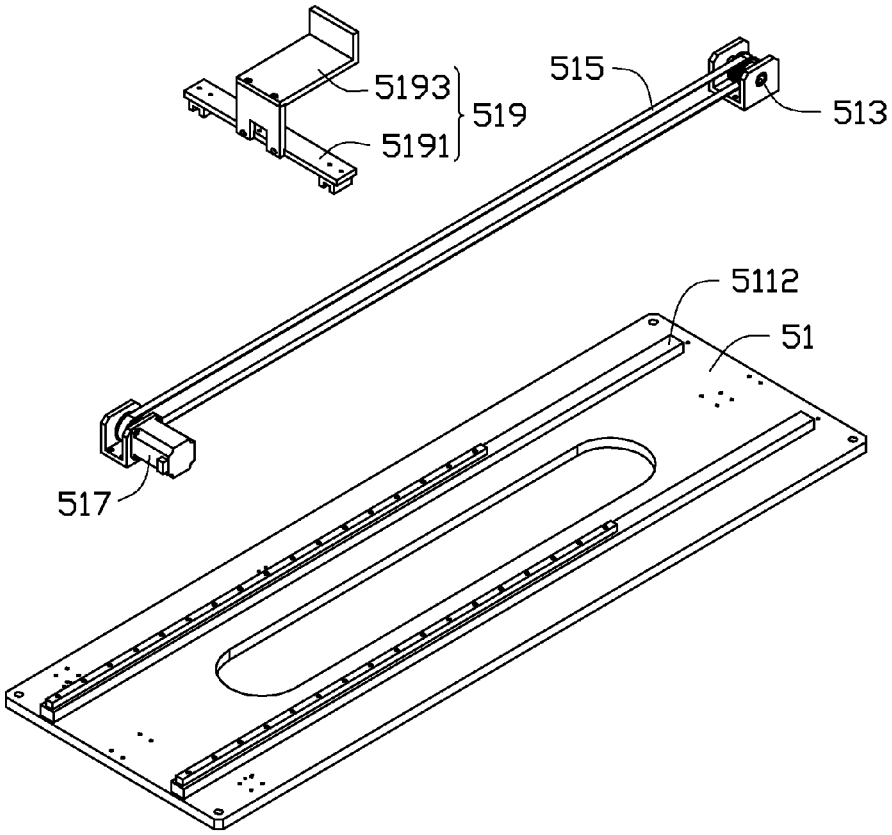
FIG. 6 is an exploded, isometric view of the feeding assembly of the packaging device shown in FIG. 5.
Figure 7:
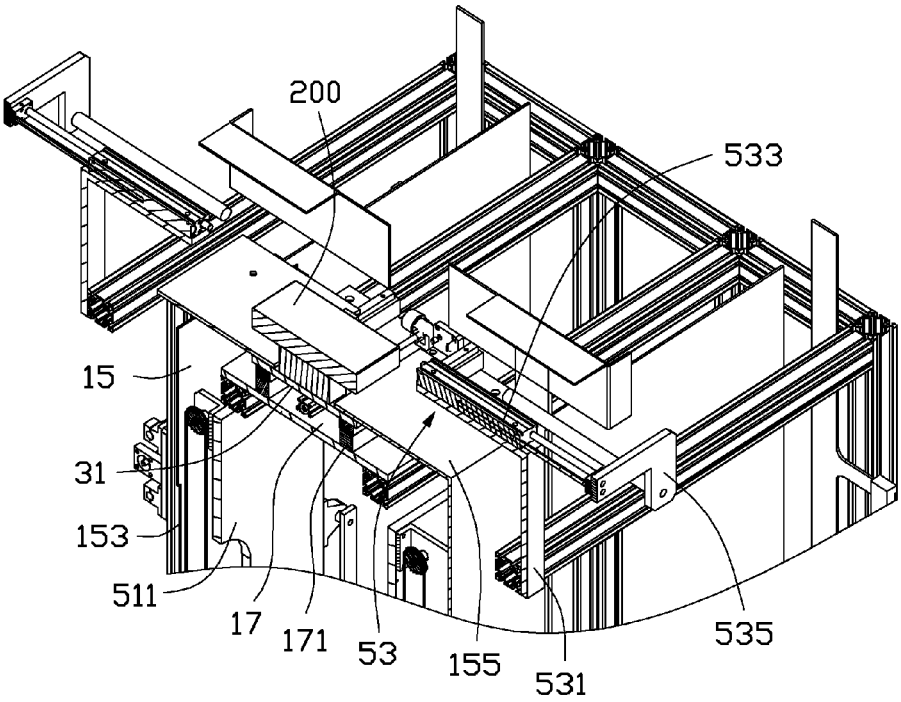
FIG. 7 is a cut-away view of the packaging device shown in FIG. 1.
Figure 8:
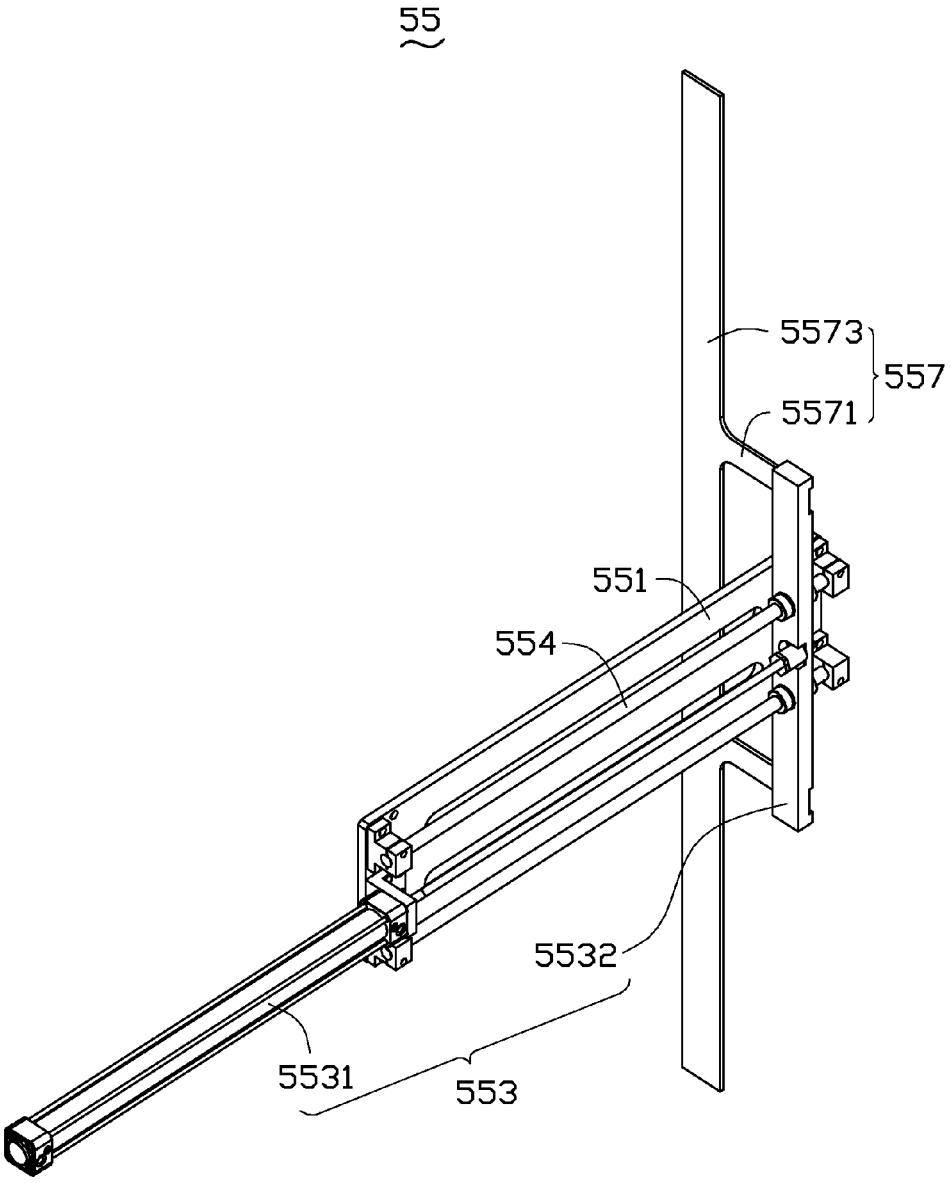
FIG. 8 is an isometric view of the pre-feeding assembly of the packaging device shown in FIG. 1.
Figure 9:
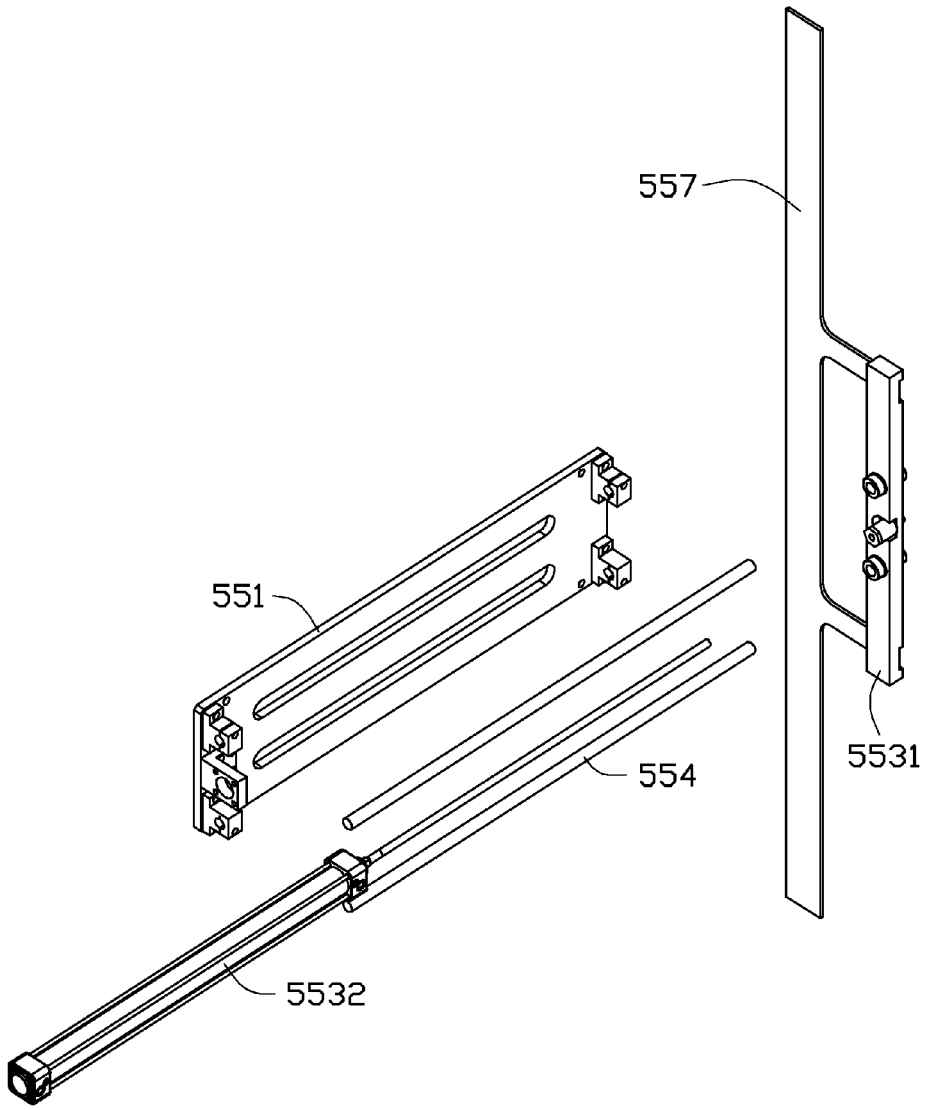
FIG. 9 is an exploded, isometric view of the pre-feeding assembly of the packaging device shown in FIG. 8.

FIGS. 3 and 4 show the conveying mechanism 30 positioned on the pair of guiding rails 171. The conveying mechanism 30 includes a sliding base 31, a telescopic driver 33, and a telescopic cylinder 35. The sliding base 31 is movably mounted on the pair of guiding rails 171. The telescopic driver 33 is slidably mounted on the third mounting plate 17, and is connected to the sliding base 31. Therefore, the telescopic driver 33 moves the sliding base 31 along the pair of guiding rails 171. The telescopic cylinder 35 is fixed on a top surface of the sliding base 31 away from the telescopic driver 33. The telescopic cylinder 35 includes a clamping portion 351, for clamping the workpiece 200. The telescopic cylinder 35 moves the workpiece 200 being clamped by the clamping portion 351 to the packaging position, for packaging the protection members 201 onto the workpiece 200.

FIGS. 3 to 7 show the loading mechanisms 50. Each of the loading mechanisms 50 includes a feeding assembly 51 and a pushing assembly 53. The feeding assembly 51 is mounted on the frame 11, and is located at a side of the second mounting plate 15 away from the corresponding first mounting plate 13. The feeding assembly 51 includes a guiding base 511, two rolling members 513, a belt 515, a first driver 517, and a bearing member 519. The guiding base 511 is fixed within the frame 11, and is substantially parallel to the second mounting plate 15. A pair of rails 5112 substantially extending along the Z direction is positioned on the guiding base 511. The two rolling members 513 are respectively mounted at opposite ends of the guiding base 511, and the pair of rails 5112 are positioned on opposite sides of the rolling members 513, respectively. The belt 515 is sleeved on the rolling members 513. The first driver 517 is mounted on one end of the guiding base 511, and is electrically connected to the adjacent rolling member 513, to rotate the belt 515 along the Z direction. In the illustrated embodiment, the rolling members 513 are rollers. The first driver 517 is a motor.

The bearing member 519 is movably mounted on the rails 5112, and is fixed to the belt 515. Therefore, the bearing member 519 is moved by the belt 515. The bearing member 519 includes a connecting portion 5191 and a bearing portion 5193. The connecting portion 5191 is movably mounted on the rails 5112, and is fixed to the belt 515. The bearing portion 5193 is inserted into the sliding groove 153 of the second mounting plate 15, and is substantially coplanar with the support portion 132, for supporting the protection members 201. When the belt 515 moves along the Z direction driven by the first driver 517, the bearing member 519 moves along the sliding groove 153, thereby moving the protection members 201 along the Z direction.

The pushing assemblies 53 are mounted on the top surface of the frame 11, and are respectively positioned above the corresponding guiding portions 155. Each pushing assembly 53 includes a bracket 531, a second driver 533, and a pushing member 535. The bracket 531 is mounted on the top surface of the frame 11, and is positioned above the feeding assembly 51. The second driver 533 is fixed on the bracket 531, and is positioned above the corresponding guiding portion 155. The second driver 533 includes a driving portion 5331. The pushing member 535 includes a fixing portion 5351 fixed to the driving portion 5331, and two pushing rods 5353 perpendicularly extending from two ends of the fixing portion 5351. The two pushing rods 5353 are positioned above the guiding portion 155. The second drivers 533 of the two pushing assemblies 53 respectively drive the corresponding pushing rods 5353 to push the protection members 201 along the corresponding guiding portion 155, to fittingly engage onto the sides of the workpiece 200.

Each of the loading mechanisms 50 further comprises two pre-feeding assemblies 55. The pre-feeding assemblies 55 are mounted on opposite sides of the frame 11, and configured corresponding to the feeding assemblies 51. Each of the pre-feeding assemblies 55 is positioned adjacent to the guiding grooves 135 of the corresponding first mounting plate 13. Each of the pre-feeding assemblies 55 includes a seat 551, a third driver 553, two guiding rods 554, and a shoving member 557. The seat 551 extends along the Y direction and is fixed on the frame 11; in addition, the seat 551 is adjacent to the guiding grooves 135, and is parallel to the first mounting plate 13. The third driver 553 includes a driving body 5531, and a driving end 5532 connected to the driving body 5531. The driving body 5531 is fixed on the seat 551. The guiding rods 554 extend along the Y direction and are mounted on the seat 551. The guiding rods 554 are movably connected to the driving body 5531 and are fixed to the driving end 5532. Thus, the driving body 5531 drives the driving end 5532 to move along the Y direction. The shoving member 557 is mounted on the driving end 5532, and includes two linking portions 5571, and a shoving portion 5573 connected to the two linking portions 5571. The two linking portions 5571 are perpendicularly connected to the driving end 5532. The shoving portion 5573 is substantially a bar, and is connected substantially perpendicularly to the linking portions 5571. Ends of the linking portions 5571 away from the driving end 5532 are respectively inserted into the guiding grooves 135, and are received in the receiving chamber. The shoving portion 5573 is also received in the receiving chamber. The driving body 5531 moves the driving end 5532 along the Y direction, thereby moving the shoving portion 5573 to move along the Y direction. The shoving portion 5573 pushes the plurality of protection members 201 supported by the support portion 132 to move along the Y direction, until the protection members 201 move onto the bearing portion 5193 of the feeding assembly 51.

In assembly, the conveying mechanism 30 is slidably mounted on the pair of guiding rails 171. The feeding assemblies 51 are mounted within the frame 11, and are positioned at the side of the second mounting plates 15 away from the corresponding first mounting plate 13. The pushing assemblies 53 are respectively mounted on the top surface of the frame 11, and are positioned above the corresponding guiding portion 155. The pre-feeding assemblies 55 are mounted on the frame 11, and are positioned adjacent to the corresponding guiding grooves 135.

In use, first, the plurality of protection members 201 arranged in a stack are placed on the support portion 132, and the protection members 201 are positioned adjacent to the shoving member 557. Second, the shoving member 557 pushes (the stack of) the protection members 201 along the Y direction onto the corresponding bearing portion 5193. Third, the first driver 517 moves the protection members 201 along the Z direction at intervals. Thus, the protection member 201 at the top of the stack of the plurality of protection members 201 is located adjacent to the pushing member 535, such that a bottom surface of the protection member 201 at the top of the stack of the plurality of protection members 201 meets the guiding portions 155. At the same time, the telescopic driver 33 moves the sliding base 31 to slide along the guiding rails 171, and the clamping portion 351 of the telescopic cylinder 35 holds and moves one workpiece 200 to a packaging position located above the guiding portion 155. Fifth, the second driver 533 moves the pushing rods 5353 to push the corresponding protection member 201 towards the workpiece 200. Thus, the protection member 201 is fittingly packaged to the corresponding side of the workpiece 200. And then, the workpiece 200 after being packaged with the protection members 201 are detached away or unloaded manually or automatically by a robot. The packaging device 100 repeats the above-mentioned steps, to continuously pack the protection members 201 to the plurality of workpieces 200 one by one. When one pair of the protection members 201 are (finished being) packaged to the corresponding workpiece 200, other protection members 201 that are stacked in line are placed on the support portion 132 adjacent to the shoving member 557, for pre-feeding the protection members 201 that are next in line.

In alternative embodiments, the first mounting plate 13 and the pre-feeding assembly 55 can be omitted, so that the protection members 201 are only supported by the bearing portion 5193. The rolling members 513 and the belt 515 can be omitted, so that the first driver 517 directly connects to and drives the bearing member 519. The third mounting plate 17 can be omitted, so that the conveying mechanism 30 is directly mounted on the top surface of the frame 11. The bracket 531 can be omitted, so that the second driver 533 is directly mounted to the frame 11. The seat 551 and the guiding rods 554 may be omitted, so that the third driver 553 is directly mounted on the frame 11, and the third driver 553 directly connects to and drives the shoving member 557.

It is believed that the present embodiments and their advantages will be understood from the foregoing description, and it will be apparent that various changes may be made thereto without departing from the spirit and scope of the embodiments or sacrificing all of its material advantages.

What is claimed is:

1. A packaging device, for packaging at least two protection members to edges of a workpiece, comprising:

a mounting base, the mounting base comprising:

a frame;

at least two first mounting plates mounted at the opposite sides of the frame, each of the at least two first mounting plates defining a guiding groove; and at least two second mounting plates mounted on the frame, the at least two second mounting plates being respectively positioned at a side of the corresponding one of the at least two first mounting plates adjacent to the other one of the at least two first mounting plates;

a conveying mechanism comprising:

a telescopic cylinder slidably mounted on a top surface of the mounting base, and a clamping portion mounted on the telescopic cylinder, for holding the workpiece;

at least two loading mechanisms respectively mounted on opposite sides of the mounting base, each of the at least two loading mechanism comprising:

a feeding assembly comprising:

a guiding base vertically fixed within the frame;

a first driver mounted at an end of the guiding base; and a bearing member movably mounted on the guiding base, and connected to the first driver, for bearing a plurality of protection members arranged in a stacking order, and a pushing assembly comprising:

a second driver fixed on the top surface of the frame, and perpendicular to the telescopic cylinder; and a pushing member connected to the second driver, wherein the telescopic cylinder is capable of positioning the clamping portion between the pushing members of the at least two loading mechanisms, the bearing member is capable of moving towards the top surface of the frame driven by the first driver, to transport one of the plurality of stacking protection members located at the top of the stack to the corresponding pushing member, the pushing member is capable of pushing the one corresponding stacking protection member located at the top of the stack towards the workpiece and packaging the top one stacking protection member to a corresponding edge of the workpiece;

wherein each loading mechanism further comprises a pre-feeding assembly, and each pre-feeding assembly comprises a third driver mounted on the frame, and a shoving member connected to the third driver;

the shoving member is movably inserted into the guiding groove, and the shoving member is partly received between the corresponding one of the at least two first mounting plates and the corresponding one of the at least two second mounting plates; and the third driver is capable of driving the shoving member to shove the plurality of protection members arranged in a stack until reaching the bearing member.

2. The packaging device of claim 1, wherein the feeding assembly further comprises two rolling members and a belt, the two rolling members are respectively mounted at opposite ends of the guiding base, the belt is wound on the rolling members, the first driver is connected to one of the rolling members adjacent to the first driver, and is capable of rotating the rolling members, to enable the belt to move relative to the guiding base, the bearing member is fixed to the belt, and thus the bearing member is capable of moving relative to the guiding base.

3. The packaging device of claim 1, wherein the pushing assembly further comprises a bracket fixed on the top surface of the frame, the second driver is positioned on the top surface of the frame via the bracket, the pushing member comprises a fixing portion and a pushing rod perpendicularly extending from the fixing portion towards the other pushing assembly of the at least two loading mechanisms, the fixing portion is fixed to the second driver, the second driver drives the pushing rod to push the top one of the plurality of stacking protection members towards the workpiece.

4. The packaging device of claim 1, wherein a guiding portion extends substantially perpendicularly from each of the at least two second mounting plates, and is positioned above the frame, each of the at least two second mounting plates defines a sliding groove, the bearing member is movably inserted into the sliding groove, the bearing member is capable of moving along the sliding groove driven by the first driver.

5. The packaging device of claim 4, wherein a support portion extends from a bottom of each of the at least two first mounting plates for supporting the plurality of stacking protection members, a rail is mounted on the guiding base, the bearing member comprises a connecting portion and a bearing portion perpendicularly extending from the connecting portion, the connecting portion is movably mounted on the rail, and is connected to the first driver, the bearing portion is movably inserted into the sliding groove, and is coplanar with the support portion.

6. The packaging device of claim 4, wherein the mounting base further comprises a third mounting plate, the third mounting plate is fixed on the top surface of the frame, the conveying mechanism further comprises a sliding base and a telescopic driver, the sliding base is movably mounted on the third mounting plate, the telescopic driver is mounted on the third mounting plate, and is connected to the sliding base, thereby enabling the telescopic driver to drive the sliding base to move.

7. The packaging device of claim 6, wherein a guiding rail is position on the third mounting plate, the sliding base is mounted on the guiding rail, the clamping portion is positioned above the guiding portion.

8. The packaging device of claim 1, wherein the pre-feeding assembly further comprises a seat and at least one guiding rod, the seat is horizontally fixed on the frame, and is position adjacent to the corresponding guiding groove, the at least one guiding rod is mounted on the seat, and is connected to the third driver, the shoving member comprises a linking portion connected to the third driver, and a shoving portion perpendicularly connected to the linking portion, the shoving portion is vertically positioned, to shove the plurality of stacked protection members until reaching the bearing member.

9. The packaging device of claim 8, wherein the third driver comprises a driving body and a driving end connected to the driving body, the driving body is mounted on the seat, the at least one guiding rod is movably inserted into the driving end, the shoving member is fixed to the driving end.

10. A packaging device, comprising:

a mounting base comprising:

a frame;

at least two first mounting plates mounted at the opposite sides of the frame, each of the at least two first mounting plates defining a guiding groove; and at least two second mounting plates mounted on the frame, the at least two second mounting plates being respectively positioned at a side of the corresponding one of the at least two first mounting plates adjacent to the other one of the at least two first mounting plates;

a conveying mechanism comprising:

a telescopic cylinder mounted on a top surface of the frame, and a clamping portion mounted on the telescopic cylinder, for holding a workpiece;

at least two loading mechanisms respectively mounted on opposite sides of the frame, each of the at least two loading mechanisms comprising:

a feeding assembly comprising:

a first driver mounted on one side of the frame; and a bearing member movably mounted on the frame, and connected to the first driver, for bearing a plurality of stacking protection members, and a pushing assembly comprising:

a second driver fixed on the top surface of the frame; and a pushing member connected to the second driver, wherein the telescopic cylinder is capable of positioning the clamping portion between the pushing members of the at least two loading mechanisms, the bearing member is capable of moving at intervals towards the top surface of the frame driven by the first driver, to transport one of the plurality of stacking protection members located at the top of the stack to the corresponding pushing member, the pushing member is capable of pushing the top one of the plurality of stacking protection members towards the workpiece and packaging the top one stacking protection member to a corresponding edge of the workpiece;

wherein each loading mechanism further comprises a pre-feeding assembly, and each pre-feeding assembly comprises a third driver mounted on the frame, and a shoving member connected to the third driver;

the shoving member is movably inserted into the guiding groove, and the shoving member is partly received between the corresponding one of the at least two first mounting plates and the corresponding one of the at least two second mounting plates; and the third driver is capable of driving the shoving member to shove the plurality of protection members arranged in a stack until reaching the bearing member.

11. The packaging device of claim 10, wherein the feeding assembly further comprises a guiding base mounted on the frame, two rolling members and a belt, the two rolling members are respectively mounted at opposite ends of the guiding base, the belt is wind on the rolling members, the first driver is mounted on the guiding base, and connected to one of the rolling members adjacent to the first driver, the first driver is capable of rotating the rolling members, to enable the belt to move relative to the guiding base, the bearing member is fixed to the belt, and thus the bearing member is capable of moving relative to the guiding base.

12. The packaging device of claim 10, wherein the pushing assembly further comprises a bracket fixed on the top surface of the frame, the second driver is positioned on the bracket, the pushing member comprises a fixing portion and a pushing rod perpendicularly extending from the fixing portion towards the other pushing assembly of the at least two loading mechanisms, the fixing portion is fixed to the second driver, the second driver drives the pushing rod to push the top one of the plurality of stacking protection members towards the workpiece.

13. The packaging device of claim 10, wherein a guiding portion extends perpendicularly from each of the at least two second mounting plates, and is positioned above the frame, each of the at least two second mounting plates defines a sliding groove, the bearing member is movably inserted into the sliding groove, the bearing member is capable of moving along the sliding groove driven by the first driver.

14. The packaging device of claim 13, wherein a support portion extends from a bottom of each of the at least two first mounting plates for supporting the plurality of stacking protection members, a rail is mounted on the guiding base, the bearing member comprises a connecting portion and a bearing portion perpendicularly extending from the connecting portion, the connecting portion is movably mounted on the rail, and is connected to the first driver, the bearing portion is movably inserted into the sliding groove, and is coplanar with the support portion.

15. The packaging device of claim 13, wherein the mounting base further comprises a third mounting plate, the third mounting plate is fixed on the top surface of the frame, the conveying mechanism further comprises a sliding base and a telescopic driver, the sliding base is movably mounted on the third mounting plate, the telescopic driver is mounted on the third mounting plate, and is connected to the sliding base, thereby enabling the telescopic driver to drive the sliding base to move.

16. The packaging device of claim 15, wherein a guiding rail is position on the third mounting plate, the sliding base is mounted on the guiding rail, the clamping portion is positioned above the guiding portion.

17. The packaging device of claim 10, wherein the pre-feeding assembly further comprises a seat and at least one guiding rod, the seat is horizontally fixed on the frame, and is position adjacent to the corresponding guiding groove, the at least one guiding rod is mounted on the seat, and is connected to the third driver, the shoving member comprises a linking portion connected to the third driver, and a shoving portion perpendicularly connected to the linking portion, the shoving portion is vertically positioned, to shove the plurality of stacking protection members until reaching the bearing member.

18. The packaging device of claim 17, wherein the third driver comprises a driving body and a driving end connected to the driving body, the driving body is mounted on the seat, the at least one guiding rod is movably inserted into the driving end, the shoving member is fixed to the driving end.

19. A packaging device, comprising:

a mounting base comprising:

a frame; and a third mounting plate fixed on a top surface of the frame;

a conveying mechanism comprising:

a telescopic cylinder mounted on the top surface of the frame, and a clamping portion mounted on the telescopic cylinder, for holding a workpiece;

at least two loading mechanisms respectively mounted on opposite sides of the frame, each of the at least two loading mechanisms comprising:

a feeding assembly comprising:

a first driver mounted on one side of the frame; and a bearing member movably mounted on the frame, and connected to the first driver, for bearing a plurality of stacking protection members, and a pushing assembly comprising:

a second driver fixed on the top surface of the frame; and a pushing member connected to the second driver, wherein the telescopic cylinder is capable of positioning the clamping portion between the pushing members of the at least two loading mechanisms, the bearing member is capable of moving at intervals towards the top surface of the frame driven by the first driver, to transport one of the plurality of stacking protection members located at the top of the stack to the corresponding pushing member, the pushing member is capable of pushing the top one of the plurality of stacking protection members towards the workpiece and packaging the top one stacking protection member to a corresponding edge of the workpiece; and wherein the conveying mechanism further comprises a sliding base and a telescopic driver, the sliding base is movably mounted on the third mounting plate, the telescopic driver is mounted on the third mounting plate and connected to the sliding base, thereby enabling the telescopic driver to drive the sliding base to move.

* * * * *